US011000814B1

(12) United States Patent
Wynn, Sr.

(10) Patent No.: US 11,000,814 B1
(45) Date of Patent: May 11, 2021

(54) MIXING APPARATUS WITH SHAFTS OF DIFFERENT LENGTHS HAVING CIRCULAR MEMBERS

(71) Applicant: Donald Wynn, Sr., Eustis, FL (US)

(72) Inventor: Donald Wynn, Sr., Eustis, FL (US)

( * ) Notice: Subject to any disclaimer, the term of this patent is extended or adjusted under 35 U.S.C. 154(b) by 254 days.

(21) Appl. No.: 16/194,689

(22) Filed: Nov. 19, 2018

(51) Int. Cl.
*B01F 13/00* (2006.01)
*B01F 15/00* (2006.01)

(52) U.S. Cl.
CPC ..... *B01F 13/002* (2013.01); *B01F 13/0028* (2013.01); *B01F 15/00538* (2013.01)

(58) Field of Classification Search
CPC ..... B01F 13/002; B01F 15/00538; B01F 7/00591; B01F 13/0028
USPC ..... 366/129
See application file for complete search history.

(56) References Cited

U.S. PATENT DOCUMENTS 122,075 A * 12/1871 Still ..... B01F 7/00591 416/91
407,672 A * 7/1889 Littlefield ..... B01F 7/00591 416/64
1,779,181 A * 10/1930 McDonald ..... B01F 3/04539 261/87
1,846,027 A * 2/1932 Eaton ..... A47J 43/07 366/328.2
2,106,529 A * 1/1938 Keller ..... C12C 7/065 366/329.1
2,800,315 A * 7/1957 Griesbach ..... B01F 3/04539 261/87
3,166,303 A 1/1965 Chapman
3,704,009 A * 11/1972 Kalbskopf ..... C02F 3/16 261/91
5,037,209 A * 8/1991 Wyss ..... B01F 7/00591 366/246
5,785,424 A * 7/1998 Noda ..... B01F 7/00241 366/317
6,921,194 B2 * 7/2005 Weber ..... B01F 7/00558 366/325.1
7,665,886 B2 * 2/2010 Morris, Jr. ..... B01F 7/18 366/262

(Continued)

FOREIGN PATENT DOCUMENTS

CH 333494 A * 10/1958 ..... B01F 7/00591
DE 4343113 A1 * 7/1994 ..... C03B 5/1875

(Continued)

*Primary Examiner* — Charles Cooley
(74) *Attorney, Agent, or Firm* — Sanchelima & Associates, P.A.; Christian Sanchelima; Alexander Rodriguez

(57) ABSTRACT

A mixing apparatus includes a first shaft, second shaft, and third shaft. The first shaft of a first length has a first end and a second end. The second shaft of a second length is fixed with the second end of the first shaft at a midpoint of the second shaft. The third shaft of a third length is fixed with the first shaft proximate to the second end of the first shaft from one end. The first, second, and third longitudinal axis of the first, second, and third shafts, respectively, are mutually perpendicular to each other. Each of the two ends of the second shaft and other end of the third shaft are fixed with a circular member with a cavity therein such that a circular axis of the first and second circular members fixed at two ends of the second member which are parallel to third longitudinal axis.

9 Claims, 2 Drawing Sheets

(56) References Cited

U.S. PATENT DOCUMENTS

| | | | | |
|---|---|---|---|---|
| 7,665,887 | B2 * | 2/2010 | Morris, Jr. | B01F 7/00158 366/262 |
| 8,876,369 | B1 * | 11/2014 | Lott | B01F 7/16 366/328.2 |
| 9,596,877 | B2 * | 3/2017 | Krumpe | A47J 43/105 |
| 2009/0110502 | A1 * | 4/2009 | Brooks | B28C 5/1215 408/227 |
| 2011/0249529 | A1 * | 10/2011 | Hirzel | B01F 7/00541 366/343 |
| 2013/0136617 | A1 * | 5/2013 | Wang | B01F 7/00466 416/235 |

FOREIGN PATENT DOCUMENTS

| | | | | | |
|---|---|---|---|---|---|
| DE | 102016114735 | A1 * | 2/2018 | | B01F 7/00591 |
| EP | 0530839 | A1 * | 3/1993 | | B01F 5/0413 |
| GB | 667954 | A * | 3/1952 | | B01F 7/00591 |
| GB | 695227 | A * | 8/1953 | | B01F 7/00591 |
| SU | 1095973 | A1 * | 6/1984 | | B01F 7/00591 |
| SU | 1278010 | A1 * | 12/1986 | | B01F 11/0233 |

* cited by examiner

MIXING APPARATUS WITH SHAFTS OF DIFFERENT LENGTHS HAVING CIRCULAR MEMBERS

BACKGROUND OF THE INVENTION

1. Field of the Invention

The present disclosure relates to a mixing apparatus. More particularly, the present disclosure relates to a mixing apparatus for mixing purposes.

2. Description of the Related Art

Currently, traditional mixing methods are used to mix items, such as paints, adhesives and other such viscous fluids and compounds, to prepare a consistency required for doing a task, such as a maintenance job, well. However, such traditional methods may not be effective and easy to use.

Several designs of mixing apparatuses have been presented in the past. None of them, however, presents a user friendly, effective, fast, simple to use, and efficient apparatus that may be utilized for mixing purposes.

Applicant believes that a related reference corresponds to U.S. Pat. No. 3,166,303A by Barton B Chapman that discloses a power driven mixing device used for mixing substances. The power driven mixing device comprises two blades that upon rotation, mixes the substances. However, power driven mixing device is not easy to handle and not efficient for mixing fluids.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to a mixing apparatus comprising first shaft, second shaft, and third shaft. First shaft of first length has first end and second end. Second shaft of second length is fixed with second end of first shaft at midpoint of second shaft. Third shaft of third length is fixed with first shaft proximate to second end of first shaft from one end. First, second, and third longitudinal axis of first, second, and third shafts, respectively, are mutually perpendicular to each other. Each of two ends of second shaft and other end of third shaft are fixed with a circular member with a cavity therein such that circular axis of first and second circular members fixed at two ends of second member are parallel to third longitudinal axis. Circular axis of third circular member fixed at other end of third member is parallel to second longitudinal axis.

First end of first shaft may correspond to shank member of a defined shape so that first end of first shaft is mechanically coupled in chuck member of another apparatus such that other apparatus imparts a rotational motion to mixing apparatus around first longitudinal axis. First, second, and third circular members are fixed by weldments in vertical alignments extending towards first end of first shaft. Lowermost surfaces of first, second, and third circular members are fixed by weldments at upper surfaces of second and third shaft, respectively. One end of third shaft is fixed with first shaft at a defined distance from second end of first shaft.

In an embodiment, first length of first shaft is longest. Second length of second shaft is substantially one fourth of first length of first shaft. Third length of third shaft is substantially one half of second length of second shaft.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
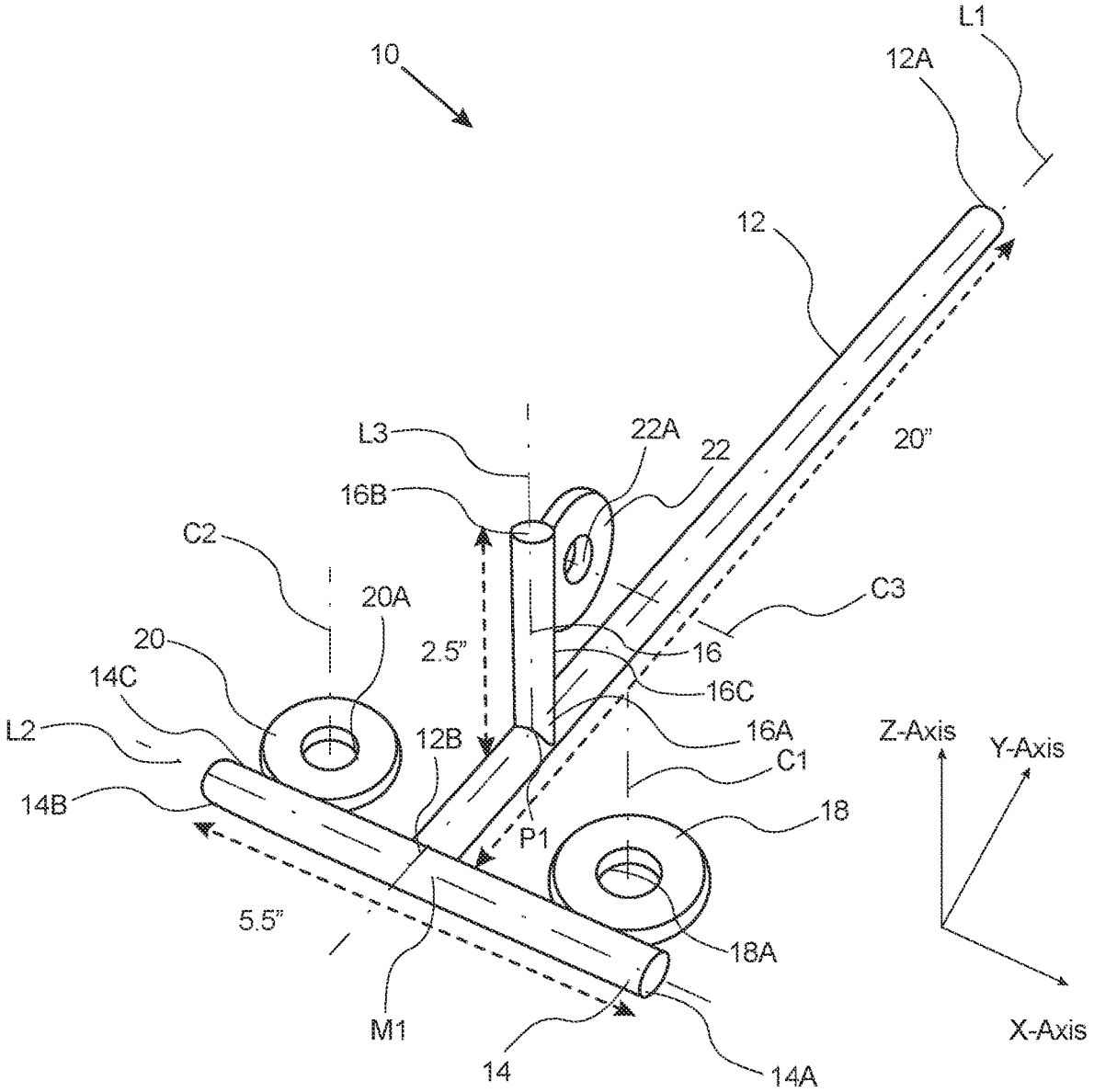
FIG. 1 represents a structure of mixing apparatus 10 of present invention, according to an embodiment described herein.

Referring now to the drawings, FIGS. 1 to 2A, where the present invention is generally referred to with numeral 10, it can be observed that a mixing apparatus, in accordance with one embodiment, is provided that includes various components, a described hereinafter.

FIG. 1 represents a structure of mixing apparatus 10 of present invention, according to an embodiment described herein. As shown in FIG. 1, mixing apparatus comprises three shafts: first shaft 12, second shaft 14, and third shaft 16. First shaft 12 is of a first length, for example greater than 20 inches. First shaft 12 has first end 12A and second end 12B. First end 12A of first shaft 12 corresponds to a shank member of a defined shape, such as hexagonal, triangular, or square shape. Length of first shaft 12 extends along first longitudinal axis L1. For reference purposes, first longitudinal axis L1 may be considered to be along Y-Axis.

Second shaft 14 of is of a second length, for example 5.5 inches. Second shaft 14 has one end 14A and opposite end 14B. Length of second shaft 14 extends along second longitudinal axis L2. For reference purposes, second longitudinal axis L2 may be considered to be along X-Axis.

Third shaft 16 of is of a third length, for example 2.5 inches. Third shaft 16 has one end 16A and opposite end 16B. Length of third shaft 16 extends along third longitudinal axis L3. For reference purposes, third longitudinal axis L3 may be considered to be along Z-Axis.

Thus, in an embodiment, first length of first shaft 12 is longest. Second length of second shaft 14 is substantially one fourth of first length of first shaft 12. Third length of third shaft 16 is substantially one half of second length of second shaft 14. However, lengths may vary from above examples, without any deviation from scope of disclosure.

In an embodiment, second shaft 14 is fixed with second end 12B of first shaft 12 at midpoint M1 of second shaft 14. In accordance with above example, midpoint M1 may be located at about 2.25 inches from either of two ends 14A and 14B. Second shaft 14 may be fixed with first shaft 12 at midpoint M1 of second shaft 14, for example, by weldments, or other such permanent fastening mechanism.

In an embodiment, third shaft 16 is fixed with first shaft 12 at point P1 proximate to second end 12B of first shaft 12. Third shaft 16 is fixed with first shaft 12 at point P1 from one end 16A. In accordance with above example, point P1 may be located at about 20 inches from first end 12A of first shaft 12. Third shaft 16 may be fixed with first shaft 12 at point P1 of first shaft 12, for example, by weldments, or other such permanent fastening mechanism.

Once fixed in accordance with above discussed structure, first longitudinal axis L1 of first shaft 12, second longitudinal axis L2 of second shaft 14, and third longitudinal axis L3 of third shaft 16, are mutually perpendicular to each other.

Further, structure of mixing apparatus 10 may comprise circular members, for example first circular member 18, second circular member 20, and third circular member 22. Each circular member has a cavity of defined diameter therein. For example, first circular member 18 has a first cavity 18A, second circular member 20 has a second cavity 20A, and third circular member 22 has a third cavity 22A.

First circular member 18 is fixed on second shaft 14 proximal to one end 14A. First circular member 18 is fixed by weldments in vertical alignment extending towards first end 12A of first shaft 12. Lowermost surface of first circular member 18 is fixed by weldments at upper surface 14C of second shaft 14. Structurally, circular axis C1 of first circular member 18 fixed proximal to one end 14A of second shaft 14 is parallel to third longitudinal axis L1 of third shaft 16.

Second circular member 20 is fixed on second shaft 14 proximal to other end 14B. Second circular member 20 is fixed by weldments in vertical alignment extending towards first end 12A of first shaft 12. Lowermost surface of second circular member 20 is fixed by weldments at upper surface 14C of second shaft 14. Structurally, circular axis C2 of second circular member 20 fixed proximal to other end 14B of second shaft 14 is also parallel to third longitudinal axis L1 of third shaft 16.

Second circular member 20 is fixed on second shaft 14 proximal to other end 14B. Second circular member 20 is fixed by weldments in vertical alignment extending towards first end 12A of first shaft 12. Lowermost surface of second circular member 20 is fixed by weldments at upper surface 14C of second shaft 14. Structurally, circular axis C2 of second circular member 20 fixed proximal to other end 14B of second shaft 14 is also parallel to third longitudinal axis L1 of third shaft 16.

Third circular member 22 is fixed on third shaft 16 proximal to one end 16B when other end 16A is fixed with first shaft 12 at point P1. Third circular member 22 is fixed by weldments in vertical alignment extending towards first end 12A of first shaft 12. Lowermost surface of third circular member 22 is fixed by weldments at upper surface 16C of third shaft 16. Structurally, circular axis C3 of third circular member 22 fixed proximal to one end 16B of third shaft 16 is also parallel to second longitudinal axis L2 of second shaft 14.

Figures 2, 2A:
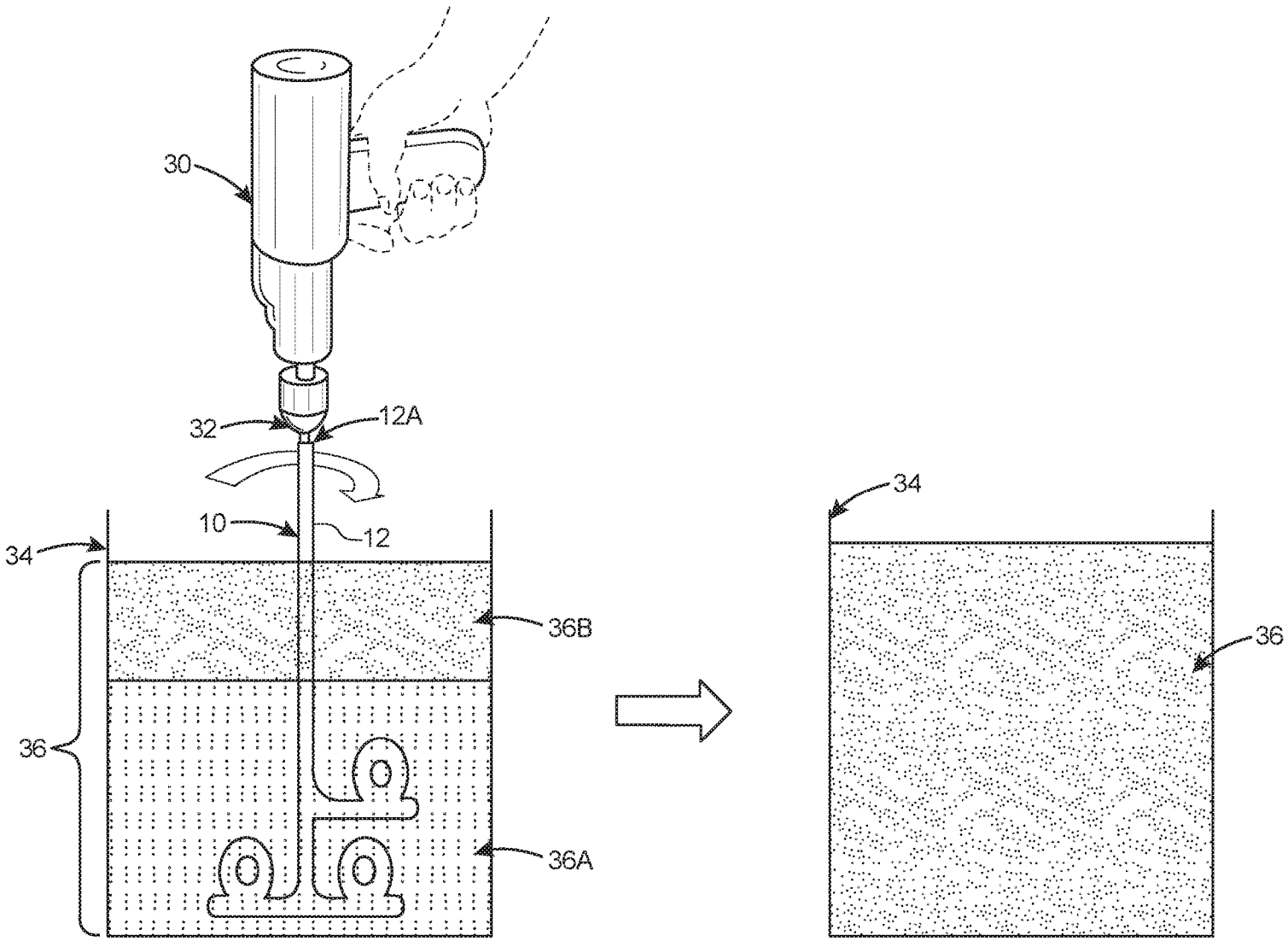
FIGS. 2 and 2A represent a use case of mixing apparatus 10, according to an embodiment described herein.

FIGS. 2 and 2A represent a use case of mixing apparatus 10, according to an embodiment described herein. FIG. 2 illustrates mixing apparatus 10 mechanically coupled in chuck member 32 of another apparatus, such as a drill machine 30, or other such rotary device. Chuck member 32 is a specialized type of clamp that may be used to hold tool or workpiece with radial symmetry, for example mixing apparatus 10 in present disclosure.

In an embodiment, chuck member 32 may have jaws that are arranged in a radially symmetrical pattern like points of a star. Jaws may be tightened up to hold tool or workpiece with help of a chuck key, which may be a wrench-like tool made for the purpose. In an embodiment, a jawed chuck member 32 may be keyless, i.e. tightening and loosening may be done by hand force alone. Such keyless designs may offer convenience of quicker and easier chucking and unchucking, In another embodiment, chuck member 32 may be a collet chuck having collets (instead of jaws). Collets are flexible collars or sleeves that fit closely around tool or workpiece and grip it when squeezed.

As described above, first end 12A of first shaft 12 corresponds to a shank member of a defined shape, such as hexagonal or square shape. First end 12A of first shaft 12 may act as a shank member to be held in chuck member 32 of drill machine 30. When powered and triggered, drill machine 30 may impart a rotational motion to mixing apparatus 10 around first longitudinal axis L1 of first shaft 12.

In a use case illustrated in FIG. 2, there may be a container 34 filled with a fluid 36. In various examples, fluid 36 may be paint, an adhesive, or other such viscous liquids. However, due to being stationary for a long time, components of different consistencies, such as 36A and 36B, may get segregated, and thicker consistency component 36A may settle at bottom of container 34. However, when fluid 36 is to be used, fluid 36 is required to be mixed well first. User may mechanically couple first end 12A of mixing apparatus 10 within chuck member 32 of drill machine 30. Upon being powered and triggered, drill machine 30 may impart a rotational motion to mixing apparatus 10 around first longitudinal axis L1 of first shaft 12. Rotational motion imparted to mixing apparatus 10 may cause attached first shaft 12 to rotate at a high speed. First shaft 12, and integrated agitator comprising second shaft 14, third shaft 16, and circular members 18, 20 and 22, may cut through a substance, such as fluid 36, creating a swirling motion that thoroughly mixes component 36A and 36B in container 34, thus prepares fluid 36, which is ready to use, as shown in FIG. 2A.

Thus, mixing apparatus 10 provides an effective way to mix paint, drywall compound, or concrete within a can or a bucket. Design of mixing apparatus 10 provides various other benefits. Mixing apparatus 10 eliminates need to manually mix contents, saves time and effort, convenient and easy to use, provides portability and ideal for contractors, painters, commercial workers, concrete workers, and do-it-yourselfers.

Mixing apparatus 10 may be made from steel, and producible in design variations including a variety of sizes. Mixing apparatus 10 may be available in marketing outlets, such as, but not limited to, home centers, hardware stores, discount departmental stores, wholesalers of hardware items.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A mixing apparatus, comprising:

a first shaft of a first length, said first shaft having a first end and a second end;

a second shaft of a second length, wherein a midpoint of said second shaft is fixed with said second end of said first shaft;

a third shaft of a third length, wherein one end of said third shaft is fixed with the first shaft proximate to said second end of said first shaft, wherein a first longitudinal axis of said first shaft, a second longitudinal axis of said second shaft, and a third longitudinal axis of said third shaft are mutually perpendicular to each other, and wherein each of the two ends of said second shaft and the other end of said third shaft are fixed with a circular member with a cavity therein such that an axis of each of first and second of said circular members fixed at said two ends of said second shaft is parallel to said third longitudinal axis, and an axis of a third of said circular members fixed at the other end of said third shaft is parallel to said second longitudinal axis.

2. The mixing apparatus of claim 1, wherein said first end of said first shaft corresponds to a shank member of a defined shape.

3. The mixing apparatus of claim 2, wherein said first end of said first shaft is mechanically coupled in a chuck member of another apparatus such that the other apparatus imparts a rotational motion to said mixing apparatus around said first longitudinal axis.

4. The mixing apparatus of claim 1, wherein said first, second, and third circular members are fixed by weldments in vertical alignments extending towards said first end of said first shaft.

5. The mixing apparatus of claim 4, wherein lowermost surfaces of said first, second, and third circular members are fixed by weldments at upper surfaces of said second and third shaft, respectively.

6. The mixing apparatus of claim 1, wherein said one end of said third shaft is fixed with said first shaft at a defined distance from said second end of said first shaft.

7. The mixing apparatus of claim 1, wherein said first length of said first shaft is longer than the length of each of said second shaft and said third shaft.

8. The mixing apparatus of claim 1, wherein said second length of said second shaft is substantially one fourth of said first length of said first shaft.

9. The mixing apparatus of claim 1, and wherein said third length of said third shaft is substantially one half of said second length of said second shaft.

* * * * *